United States Patent [19]

Ignatjev

[11] 4,066,018

[45] Jan. 3, 1978

[54] PROPELLER DISK PROJECTILE

[76] Inventor: Vladimir Ignatjev, 39 Ledgewood Drive, Norwalk, Conn. 06850

[21] Appl. No.: 759,230

[22] Filed: Jan. 13, 1977

[51] Int. Cl.[2] ..... F42B 13/48

[52] U.S. Cl. ..... 102/67

[58] Field of Search ..... 102/38, 67, 69, 91

[56] References Cited

U.S. PATENT DOCUMENTS

| | | | |
|---|---|---|---|
| 1,244,046 | 10/1917 | Ffrench | 102/67 |
| 3,500,714 | 3/1970 | Cullinane | 102/38 |
| 3,951,040 | 4/1976 | Ziemba | 102/38 |

*Primary Examiner*—Verlin R. Pendegrass

*Attorney, Agent, or Firm*—Nathan Edelberg; Robert P. Gibson; Max Yarmovsky

[57] ABSTRACT

A spin fired anti-aircraft projectile is fuzed to dispense circularly shaped propeller disks into a standing, ascending or descending type of fragment cloud in front of an invading target. The propeller disk warhead is designed to release a plurality of rotating disk shaped fragments having serrated peripheral cutting edges thereon which are capable of penetrating and incapacitating fast moving enemy aircraft.

3 Claims, 4 Drawing Figures

PROPELLER DISK PROJECTILE

GOVERNMENTAL INTEREST

The invention described herein may be manufactured, used and licensed by or for the Government for governmental purposes without the payment to me of any royalty thereon.

BACKGROUND OF INVENTION

Various means have been used in the prior art in attempts to solve the problem of low lethal effectiveness of anti-aircraft projectiles against fast moving enemy aircraft. Prior art anti-aircraft weapon designers tried to overcome this deficiency in weapon effectiveness by making improvements in the range finding equipment. To improve effectiveness recent weapon systems have utilized computer and radar technology coupled with projectiles having the capability of being armed and fuzed by radar signals while in flight or immediately prior to being fired. In some instances the low lethality problem has been attacked by prior art munitions devices sensitive to guidance by using laser or radar beams. These laser guided or radar guided warheads were generally of the unitary fragmenting or cluster fragmenting type.

One of the problems with these prior art devices, when used against fast moving targets, has been the short duration of time the impacting lethal fragment cloud remained in the target area. Another problem with some of these aforementioned prior art devices has been that the warhead fragment distribution was generally substantially in a single plane. This single plane distribution requires initiation of the warhead at a precise altitude in order to be effective. Another factor which reduced lethality was the small percentage of active fragments available to impact the target because of a substantially radial distribution of the fragments. Another problem with prior art fragmenting warheads has been the low specific mass of the fragments available for use against the target which resulted from the relatively large volume occupied by the high explosive. In addition, the past fragmenting warhead devices have been less effective than the present invention against targets because of the relatively small impacting energy available to the small chaff size fragment formed when the prior art devices exploded. And finally the rotational energy given to prior art munitions from the spin of the warhead was frequently dissipated by the fragment mass because of wind drag prior to impact in its travel toward the target.

SUMMARY OF THE INVENTION

The present invention relates to a propeller disk anti-aircraft spin fired projectile which disperses a plurality of circularly shaped rotating members which have the capability of being dispersed in a standing, ascending or descending fragment piercing cloud in front of an enemy aircraft.

An object of the present invention is to provide a propeller disk anti-aircraft spin fired projectile with a plurality of disk shaped cutting members which can be dispensed in a lethal cloud which can remain in a target area for a substantial period of time.

Another object of the present invention is to provide a propeller disk anti-aircraft spin fired projectile having a plurality of intercepting cutting disks capable of being distributed in a vertical plane.

Another object of the present invention is to provide a propeller disk anti-aircraft spin-fired projectile having fragments of uniform lethal effectiveness.

Another object of the present invention is to provide a propeller disk anti-aircraft projectile having a relatively large fragment disk mass in comparison with the mass occupied by the warhead fragment dispensing propellant charge.

A further object of the present invention is to provide a propeller disk anti-aircraft spin-fired projectile wherein the rotational energy of the projectile is partially stored in a plurality of disks forming a fragment cloud used to destroy an aircraft flying therethrough.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 3:
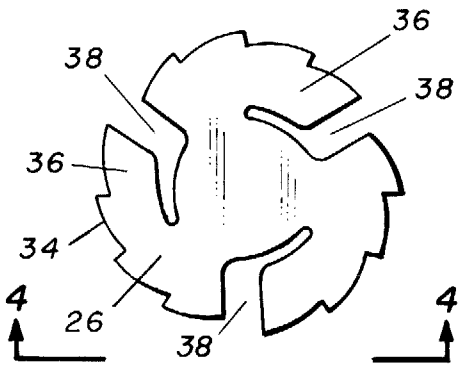
FIG. 3 is a top view of a propeller disk member.
Figure 4:
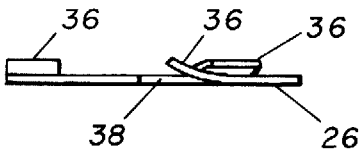
FIG. 4 is a side view of the propeller disk member taken along line 4—4 of FIG. 3.
Figure 2:
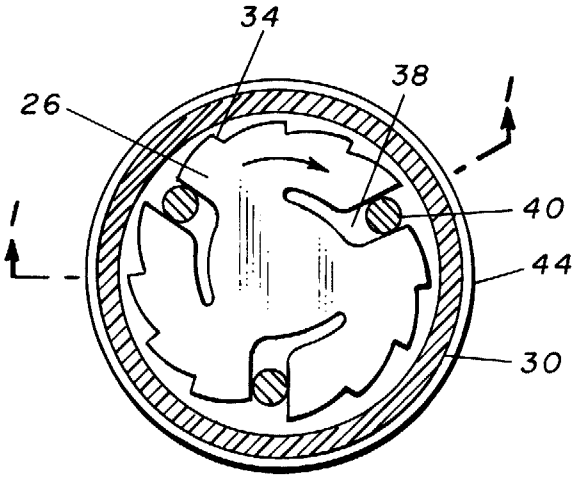
FIG. 2 is cross-sectional view taken along line 2—2 of FIG. 1.
Figure 1:
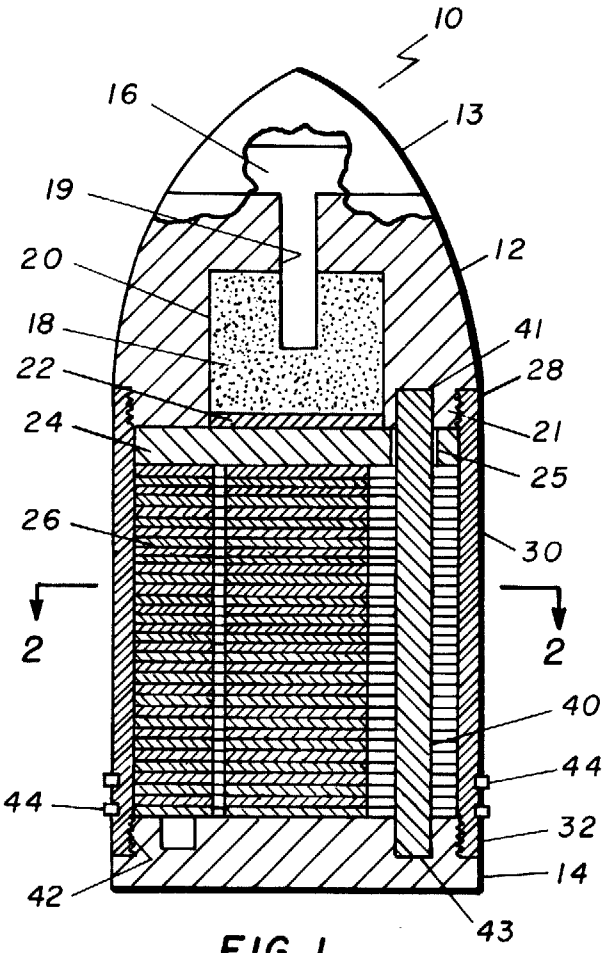
FIG. 1 is a partial, longitudinal cross-sectional view of a propeller disk projectile taken along line 1—1 of FIG. 2.

Referring now to FIGS. 1-4 projectile 10 has an ogival shaped member end 12 and a threaded rear end member 14. The ogival shaped member 12 has a pointed forward end 13 which has a time fuze 16 operatively positioned therein. A propellant charge 18 is disposed in an axially positioned propellant charge counterbore 20 located in the ogival member rear end boss 21 and contained therein by propellant charge sealing disk member 22. Sealing disk 22 retains the propellant charge 18 in the counterbore 20 during assembly of the projectile. Time fuze 16 indicates and communicates with the propellant charge 18 through a central bore 19. A slidable piston member 24 is positioned intermediate sealing disk member 22 and a plurality of propeller disk fragment members 26 which are also slidably disposed within the interior of cylindrically shaped projectile 10. The internally threaded upper end 28 of the projectile cylindrical tubular body member 30 is threadedly affixed to the externally threaded rear end boss 21 of ogival shaped member 12. The internally threaded lower end 32 of the projectile cylinder tubular body member 30 is threadedly attached to projectile shear threaded rear end member 14. The propeller disks 26 may be made of such material as tool steel in order to enhance their lethal effectiveness. Disks 26 have sharp teeth 34 peripherally disposed on the circumferential edges of disks 26 and three bent integral propeller sections 36 equally spaced around the circumference of disk 26 by three cut out radially positioned disk grooves 38 which help to transmit the rotational spin energy of the projectile to the disks 26. Three disk positioning rods 40 are slidably positioned in grooves 38 and slidably pass through piston rod holes 25, one of three being shown in FIG. 1, and have ends releasably located in holes 41 of the ogival member rear end 21 and in annular groove 43 located in the upper face of rear end member 14. Rifling hands 44 located in the exterior wall of the body member lower end 32 give the projectile the necessary spin for accurate trajectory and give the disks 26 potential rotational energy to expend against a target.

In operation the propeller disks 26, after being stacked in the projectile body 30, are compressed together by threading the bottom member 14 to the body threaded lower end 32. When the projectile 10 is fired, the time fuze 16 is timed to ignite the propellant charge 18 when the projectile is in front of an invading aircraft. Gases generated by the ignited propellant charge 18 will cause the piston member 24 to move rearwardly and to apply pressure against propeller disks 26 which will in turn cause the bottom member threads 42 to shear off. As soon as the propeller disks 26 are pushed by piston 24 out of the cylindrical body member 30, the three disk positioning rods 40 will fly radially outwardly under the influence of centrifugal force, pass through grooves 38 and release the propeller disks 26. By varying the propellant charge 18 and the angle of the bend of the bent propeller sections 36 an anti-aircraft fragment disk cloud can be created in front of the aforementioned aircraft which because of the degree of aerodynamic lift is either momentarily standing, ascending or descending. The fast approaching aircraft when impacting with these propeller disk fragments will supply a portion of the needed penetrating energy, the other portion will be supplied by rotating energy of the propeller disks 26 thus helping to cut into the aircraft and substantially increase the lethal effectiveness.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention, what is claimed as new and desired to be secured by Letters Patent of the United States is:

1. A spin-fired projectile for use against enemy aircraft which comprises:

an ogival shaped member having a pointed forward end, a threaded rear end boss, an axially positioned propellant charge counterbore located in said threaded rear end boss, and a plurality of rod holes disposed in said threaded rear end boss;

a propellant charge operatively positioned in said propellant charge counterbore;

a time fuze disposed in said forward end of said ogivally shaped member, said time fuze communicating with said propellant charge;

a propellant charge sealing disk member located in said propellant charge counterbore for retaining said propellant charge in said propellant charge counterbore during assembly of said projectile;

a cylindrically shaped tubular body member having an internally upper end threaedly connected to said threaded rear end boss of said ogival member and an internally threaded lower end;

a piston member having a plurality of piston rod holes therein slidably positioned in said tubular body member adjacent said ogival member rear end boss, said piston member being movably responsive to gases generated by said propellant charge;

propeller disk fragment means, transversely slidably disposed and stacked within said tubular body member for presenting a momentarily standing, ascending or descending fragment cloud effective against said enemy aircraft when being ejected from said tubular body member;

a threaded rear end member threadedly affixed to said lower end of said tubular body member having an annular groove therein, said threaded rear end member retaining said propeller disk fragment means within said spin-fired projectile during transportation to a target, said threaded rear end member separating by shear from said lower end of said tubular body member when said time fuze initiates said propellant charge, forcing said piston member in a rearward direction and said propeller disk fragment means against said rear end member.

2. A spin-fired projectile as recited in claim 1 wherein said propeller disk fragment means comprises;

a plurality of propeller disks having a plurality of teeth peripherally disposed on the circumferential edges thereof, a plurality of bent integral propeller sections equally spaced around the circumference of said propeller disks, said propeller sections of each disk being separated from each other by a plurality of radially positioned disk grooves; and a plurality of disk positioning rods slidably positioned in said disk grooves and slidingly passing through said piston rod holes, said disk positioning rods each having one end removably disposed in the rod holes of said ogival shaped member and each other end of said rods being disposed in said annular groove of said threaded rear end member.

3. A spin-fired projectile as recited in claim 2 wherein said plurality of teeth of said plurality of propeller disks are made of tool steel to enhance the cutting effectiveness of said propeller disk when impacting with an aircraft target.

* * * * *